United States Patent [19]

Sterghos

[11] Patent Number: 4,788,847

[45] Date of Patent: Dec. 6, 1988

[54] ROD BENDING APPARATUS

[75] Inventor: Peter M. Sterghos, St. Petersburg, Fla.

[73] Assignee: Rodbuster, Inc., St. Petersburg, Fla.

[21] Appl. No.: 104,355

[22] Filed: Oct. 5, 1987

[51] Int. Cl.[4] ..... B21D 9/05

[52] U.S. Cl. ..... 72/213; 72/212; 72/373; 72/389; 72/383

[58] Field of Search ..... 72/381, 383, 386, 387, 72/389, 372, 373, 374, 212, 213, 214, 215, 217, 219

[56] References Cited

U.S. PATENT DOCUMENTS

| | | | |
|---|---|---|---|
| 2,497,622 | 2/1950 | Mueller | 72/213 |
| 3,429,157 | 2/1969 | Huth | 72/389 |
| 4,141,235 | 2/1979 | Ishihara | 72/389 |
| 4,488,425 | 12/1984 | Meikle | 72/389 |

*Primary Examiner*—David Jones

*Attorney, Agent, or Firm*—Walter J. Monacelli

[57] ABSTRACT

A rod bending device using a combination of a movable mandrel and two moving rollers, between which mandrel and which rollers the rod bending is effected, the movements of which mandrel and rollers are effected simultaneously by the same power system and by a single power stroke. The power system, preferably a hydraulic system, effects movement of the movable mandrel which in turn simultaneously effects movement of two arms which support the movable rollers. This simultaneous movement of the mandrel and the rollers effects the bending of the rod which is positioned between the mandrel and the rollers. The curvature and the degree of the bending are determined by the shape of the mandrel, the positioning of the rollers on the supporting arms and the extent of the revolution of the arms about the individual fulcrums on which the respective arms are revolved.

11 Claims, 2 Drawing Sheets

ROD BENDING APPARATUS

BACKGROUND OF THE INVENTION

1. Field of the Invention

The invention relates to apparatus for effectively and quickly bending rods. More specifically it relates to apparatus, either portable or stationary, which uses a shorter hydraulic stroke than present commercial units to make a particular angle bend. Still more specifically it relates to apparatus requiring lower horsepower or allows use of a larger diameter hydraulic cylinder to make a particular bend in a given time period. Still more specifically it relates to apparatus capable of bending rods of increased diameter merely by increasing the scale of the equipment, i.e., the hydraulic cylinder, etc.

2. State of the Prior Art

U.S. Pat. Nos. 2,620,848, 3,901,292, 4,561,279 and German Pat. No. 816,048 are representative of mechanisms relative hereto.

A fabrication machine described as capable of cutting and bending rods is marketed by Fascut Industries. This machine effects the bending of rods by means of a stationary mandrel against which the rod is pushed by two movable bending rollers positioned on the opposite side of the bar from the stationary mandrel.

Another machine marketed by Re-Rodr Co. employs two stationary rollers positioned below the bar to be bent and a movable mandrel is pressed downward on the bar from above and between the two stationary rollers.

In the first case the movable rollers are powered by a hydraulic system exerting force on the rollers against the bar to be bent. In the second case the movable mandrel is powered by a hydraulic system which exerts force on the mandrel against the rod to be bent. It appears that the force of a single power system must be directed either against the movable rollers in one case or against a movable mandrel in the other case. Since the rollers are on one side of the bar to be bent and the mandrel is on the opposite side of the bar, the power stroke delivered to the rollers is in a direction different from that delivered to the mandrel. It would appear therefore that in order to deliver simultaneous power strokes to both the mandrel and the rollers, it would appear necessary to have two power sources.

SUMMARY OF THE INVENTION

The rod bending apparatus of the present invention comprises a combination of a movable mandrel and two moving rollers, between which mandrel and which rollers the rod bending is effected, the movements of which mandrel and rollers are effected simultaneously by the same power system and by a single power stroke. In other words the power system, preferably a hydraulic system, effects movement of the movable mandrel which in turn simultaneously effects movement of two arms which support the movable rollers. This simultaneous movement of the mandrel and the rollers effects the bending of the rod which is positioned between the mandrel and the rollers. The curvature and the degree of the bending are determined by a number of factors including the shape of the mandrel, the positioning of the rollers on the supporting arms and the extent of the revolution of the arms about the individual fulcrums on which the respective arms are revolved.

As a result of the double or simultaneous movement of mandrel and rollers bending apparatus of this invention effected by the same power system is capable of effecting a degree of bending by a stroke of ½ the length required by present commercial apparatus. For example, the apparatus of this invention will effect a degree of bending with one-half the length of the hydraulic stroke required for a corresponding degree of bending by present commercial apparatus. In other words the apparatus of this invention uses a shorter hydraulic stroke than required by present commercial units to make a similar bend. This means a lower horsepower requirement or allows the use of larger diameter hydraulic cylinders to make any given bend in a given time period. Moreover the apparatus of this invention is capable of bending rods of increasing diameter merely by increasing the size of the equipment, i.e., hydraulic cylinder, etc.

BRIEF DESCRIPTION OF THE DRAWINGS

The description of the bending apparatus of this invention may be facilitated by reference to the drawings.

DESCRIPTION OF PREFERRED EMBODIMENT

Figure 1:
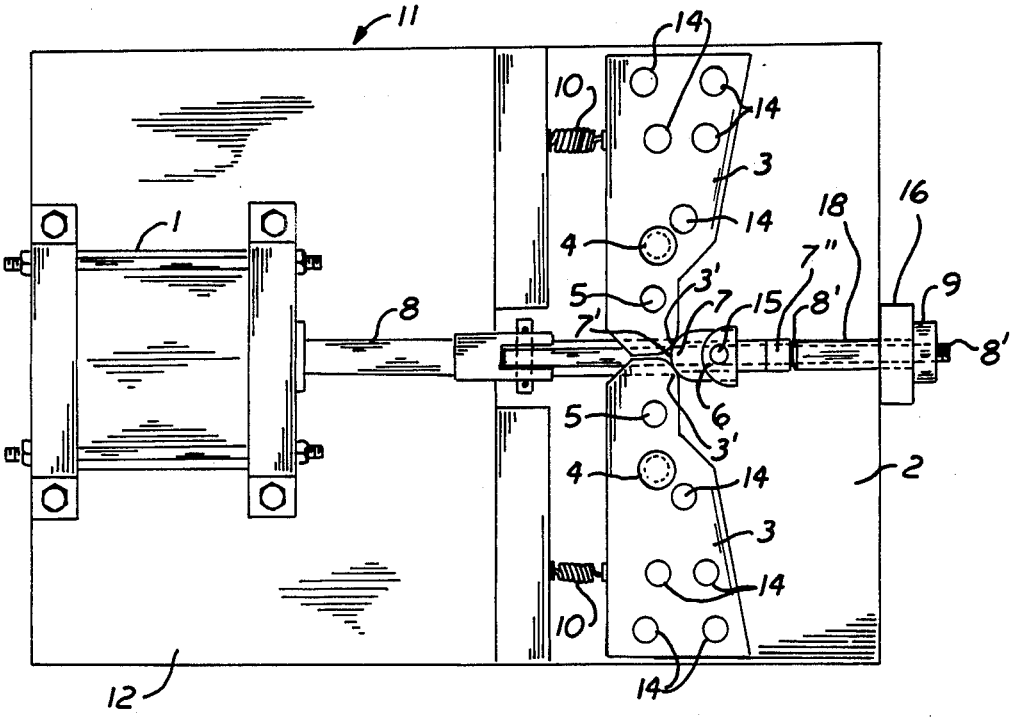
FIG. 1 is a top view of a preferred modification of this invention.

A preferred apparatus 11 of this invention includes a hydraulic system 1 from which rod 8 is actuated. Supporting plate 2 supports arms 3 which are each rotatable about fulcrum 5 and supports rollers 4 which extend upward and rotatably from arms 3. Movable mandrel 6 is supported on actuator rod 8 and its position is adjusted by turning adjusting nut 9 which by rotation on the threaded portion 8' of actuator rod 8 can advance or retract the position of the mandrel 6. Nut 9 is shown advanced to the furthest position to the left, that is against plate 16. To allow movement of mandrel 6 and actuate portion 7 to the left, nut 9 is unscrewed an appropriate distance on the threaded portion 8' of actuator rod 8. A lower actuator portion 7 of mandrel 6 projects forward and has an integral portion extending downward and backward and then a narrower portion 7'' extending upward and also lower integral portion 7''' extends downward and rests on the bottom of groove 17. Actuator portion 7 has a curved forward edge 7' which engages the rounded or curved portion 3' of arms 3 so that as the mandrel 6 is moved forward or to the left the lower actuator portion 7 engages and pushes the curved portion 3' of arms 3 and thereby rotate the arms 3 on fulcrums 5 thereby moving the rollers 4 in a direction opposite to that in which mandrel 6 is being moved. This means that, as the mandrel is being pushed or advanced to the left, the rollers 4 will be moved in the opposite direction or to the right. Therefore, for a rod positioned between mandrel 6 and rollers 4, the movement of mandrel 6 to the left will cause simultaneous movement of arms 3 so that rollers 4 will be moved in a direction generally to the right. Thus the mandrel will be moved to the left and press the middle of the bar, and rollers 4 will be moved in a direction to the right and press the bar at points spaced from the mandrel and in a direction opposite to that of the mandrel. The fact that both the mandrel and the rollers are moved means that double the amount of bend is effected as is effected when either the mandrel is or the rollers are in stationary positions.

Arms 3 are provided with a number of openings 14 to provide for different positionings of rollers 4. These openings are of sufficient diameter to receive the lower narrower portion of roller 4, advantageously providing a loose enough fit that the roller may be rotated in the opening. Obviously there are various other means by which rotatability of the rollers may be provided. However since there is not much rotation needed in the limited movement required, any simple means of rotation is satisfactory.

Figure 2:
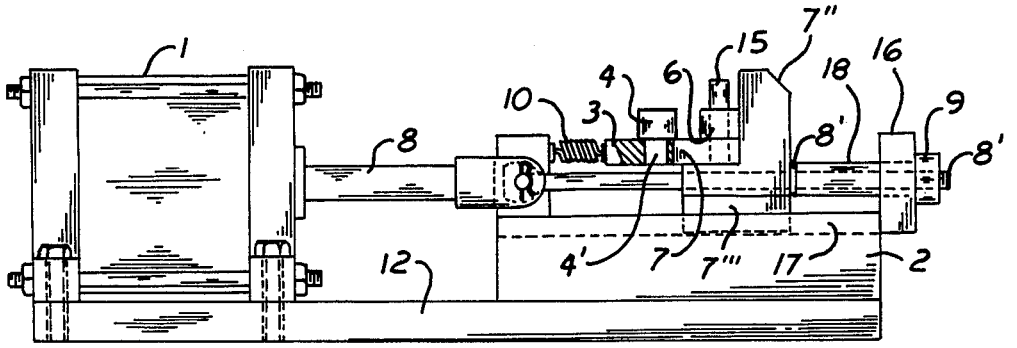
FIG. 2 is a side view of the apparatus of FIG. 1.
Figure 3:
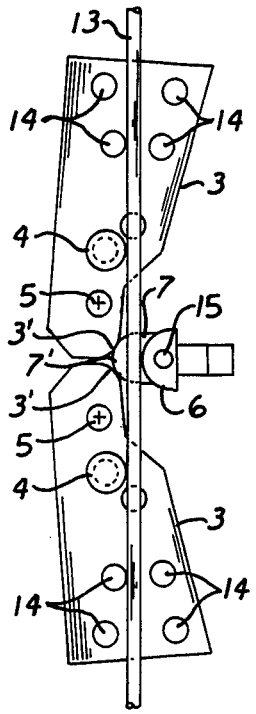
FIG. 3 is a top partial view of the portion of the apparatus comprising the mandrel and the rollers with the rod inserted before bending.

The broken away section of FIG. 2 shows the narrower lower portion of roller 4 in an opening in arm 3. The roller comprises two cylindrical portions joined to each other, the upper cylindrical portion having a larger diameter than the lower cylindrical portion 4'. One of the cylindrical portions has an axis which is an extension of the axis of the other cylindrical portion. The lower cylindrical portion 4' is adapted to fit into any one of openings 14 of arm 3 with the fitting being snug enough to prevent wobbling of the roller but loose enough to permit rotation of the roller within the opening. If desired, lubrication may be provided such as a small amount of grease on the lower portion.

Fulcrum 5 consists of a pin which is fixed to the supporting means for arm 3 and extends upward through an opening in arm 3.

Removable pin or bar 15 holds mandrel 6 in position and allows for removal and replacement of the mandrel. Mandrels of different curvatures may be used to provide for sharper or more gradual bends in the bars being bent. Thus the mandrels are changed in accordance with the size of the bar being bent and the desired radius of the bend.

The arms 3 have springs 10 attached thereto which will return to their initial positions once the actuator pressure is released. The apparatus is mounted on base 12.

Figure 4:
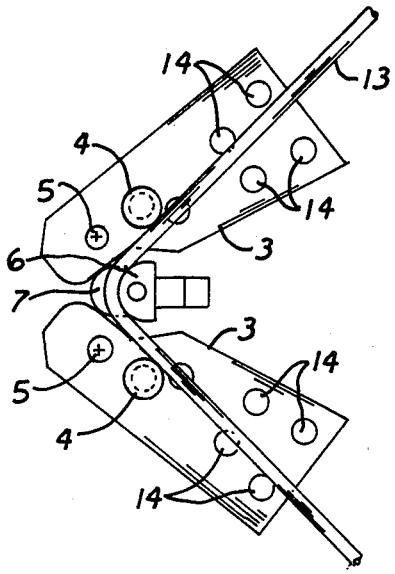
FIG. 4 is a similar partial view as in FIG. 3 except that the positions of the mandrels and the rollers have been moved to effect about a 90° bend in the rod.
Figure 5:
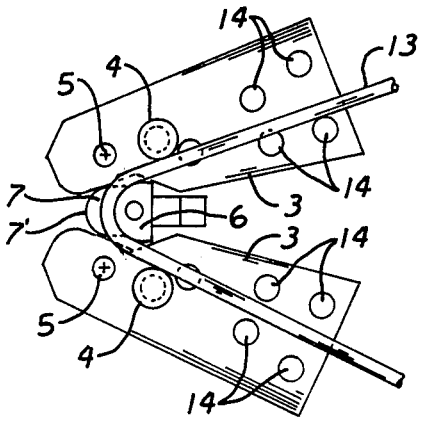
FIG. 5 is a similar partial view as in FIG. 4 except that the rod has been bent to an angle of about 135°.
Figure 6:
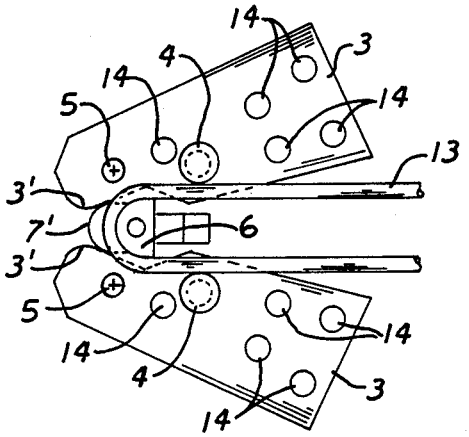
FIG. 6 is a similar partial view as in FIG. 4 except that the positions of the rollers have been changed and the rod has been bent to an angle of about 180°.

FIGS. 3–6 show a bar being bent from angles of 0° in FIG. 1, about 90° in FIG. 4, about 135° in FIG. 5 and about 180° in FIG. 6. In order to effect a bend of 180° the bar would be bent advantageously first to 135° and then the movement reversed slightly so that the rollers may be shifted into the openings 14 shown occupied in FIG. 6 and then the actuator rod 8 pushed forward to its completion to the position shown in FIG. 6.

Another advantage of the apparatus of this invention is that once adjusting nut 9 is set in position the same angle of bend will be produced in succeeding bars at the end of each stroke. Where a bend of less than 135° is desired, adjusting nut 9 is set so that there is an initial gap between the mandrel and the bar to be bent. Obviously the lower the angle of bend the bigger will be this initial gap between the mandrel and the bar. A full 2 inch stroke is used for a 135° bend.

While a hydraulic power source is described and is preferred for operation of the apparatus of this invention, other suitable power sources may also be used.

As previously stated the apparatus of this invention uses a shorter stroke, actually ½ the length of the stroke used by present commercial bending apparatus. This means that lower horsepower needs to be used, or in other words allows the use of a larger diameter hydraulic cylinder to make a given bend in a given period.

Moreover this apparatus is capable of bending rods of increased diameter merely by increasing the size of the equipment, the size of the hydraulic cylinder, etc. The apparatus of this invention may be used in conjunction with known commercial systems for cutting rods so that the same hydraulic system may be used for both purposes.

While certain features of this invention have been described in detail with respect to various embodiments thereof, it will of course be apparent that other modifications can be made within the spirit and scope of this invention and it is not intended to limit the invention to the exact details shown except insofar as they are defined in the following claims.

The invention claimed is:

1. Rod bending apparatus comprising:

(a) a rod supporting means against which the bar to be bent may be positioned;

(b) a movable mandrel positioned on one side of said rod supporting means, said mandrel having a lower actuator portion extending forward and beyond the said mandrel; said lower actuator portion having an opening extending through a lower portion thereof;

(c) a power means supported adjacent to said rod supporting means and said movable mandrel, said power means having a power thrust bar extending therefrom adapted to extend through the said opening in said lower actuator portion of said mandrel, said thrust bar having a threaded portion extending from the end most remote from said power means and extending toward said mandrel;

(d) an adjusting means having a threaded opening therein which threads fit the threads on said thrust bar, said adjusting means being capable of adjusting and controlling the position of said mandrel on said thrust bar;

(e) two pivotal arms supported on said rod supporting means and pivotal on pins projecting upward from said bar supporting means, each of said arms having a rotatable roller extending from said arm and capable of pressing against a rod positioned on said rod supporting means between said mandrel and said rollers; whereby the same power stroke of the power thrust bar is capable of moving the mandrel against the rod positioned on said rod supporting means between the mandrel and the rollers and with the movement of the mandrel the lower extended portion of the mandrel is capable of pressing the end of each said arm thereby causing the arms to pivot on said pins and press said rollers against the opposite side of said rod from said mandrel.

2. The rod bending apparatus of claim 1 in which said power system is an hydraulic system.

3. The rod bending apparatus of claim 2 in which each of said arms has a number of openings therein, each of said openings being capable of being fitted with one of said rollers.

4. The rod bending apparatus of claim 3 in which each of said rollers has two cylindrical portions of different diameters, the portion of smaller diameter joined to and extending beyond the cylindrical portion of larger diameter, said portion of smaller diameter being capable of being inserted in an opening in said arms, the fit of said smaller portion being sufficient to hold said portion but loose enough to allow rotation of said roller.

5. The rod bending apparatus of claim 4 in which said openings are positioned so that the position of the roller may be varied in accordance with the angle to which the bar is to be bent.

6. The rod bending apparatus of claim 2 in which said rod supporting means comprises the top of a work bench.

7. The rod bending apparatus of claim 6 in which said apparatus is portable.

8. The rod bending apparatus of claim 6 in which said apparatus is stationary.

9. The rod bending apparatus of claim 2 in which said rod supporting means is arranged vertically.

10. The rod bending apparatus of claim 9 in which said apparatus is portable.

11. The rod bending apparatus of claim 9 in which said apparatus is stationary.

* * * * *